United States Patent [19]

Lewis

[11] Patent Number: 4,486,169

[45] Date of Patent: Dec. 4, 1984

[54] CIGARETTE LIGHTER SECURING ACCESSORY

[76] Inventor: Marcus E. Lewis, 7821 S. Rhodes Ave., Chicago, Ill. 60619

[21] Appl. No.: 496,423

[22] Filed: May 20, 1983

[51] Int. Cl.[3] ..... F23Q 2/32

[52] U.S. Cl. ..... 431/253; 431/343; 206/85; 312/86

[58] Field of Search ..... 431/253, 343; 206/85, 206/86, 87, 88, 89, 94; 312/86, 73

[56] References Cited

U.S. PATENT DOCUMENTS

| | | | |
|---|---|---|---|
| 1,462,108 | 7/1923 | Holywell . | |
| 1,819,427 | 8/1931 | Maisto | 431/202 |
| 1,862,518 | 6/1932 | Alland | 431/253 |
| 2,737,036 | 3/1956 | Simpson | 431/343 |
| 2,789,424 | 4/1952 | Lorio | 431/253 |
| 2,958,416 | 11/1960 | Clark | 206/87 |
| 3,608,704 | 9/1971 | Kopp | 431/343 |
| 3,813,016 | 5/1974 | Bohannan . | |
| 4,000,812 | 1/1977 | Pisarski et al. | 206/87 |
| 4,082,495 | 4/1978 | Johnson . | |
| 4,223,784 | 9/1980 | Kaneyasu | 431/343 |
| 4,230,224 | 10/1980 | Weeks | 206/94 |
| 4,363,432 | 12/1982 | Warthen | 206/87 |

FOREIGN PATENT DOCUMENTS

| | | | |
|---|---|---|---|
| 332260 | 1/1920 | Fed. Rep. of Germany | 206/88 |
| 2514747 | 2/1976 | Fed. Rep. of Germany | 431/343 |
| 742426 | 12/1932 | France | 431/253 |
| 2399617 | 4/1979 | France | 431/343 |
| 2399618 | 4/1979 | France | 431/343 |

*Primary Examiner*—Samuel Scott
*Assistant Examiner*—Helen Ann Odar
*Attorney, Agent, or Firm*—Gerlach & O'Brien

[57] ABSTRACT

A cigarette lighter securing accessory includes a lighter holder connected to a lighter by extensible cord means, means for retracting the cord means from an extended position, and, preferably, means on the holder for attaching it to a support. A preferred additional element, for use with a replaceable and/or disposable lighter, is a lighter receptacle, which is removably connected to the lighter and is connected to the cord, between them.

10 Claims, 11 Drawing Figures

CIGARETTE LIGHTER SECURING ACCESSORY

BACKGROUND OF THE INVENTION

This invention relates to accessories for the prevention of loss or misplacement of cigarette lighters. More particularly, the invention relates to an accessory for securing a lighter to the person or to a fixed support.

Cigarette lighters carried on the person frequently are lost or misplaced, as by falling from a pocket, being left behind after use, or being taken by another after use. Also, the lighters may be carried in one of various pockets, or in a purse, where they may be mixed with other articles, and they may not be as accessible as desired, or they may bulge the pocket at times.

SUMMARY OF THE INVENTION

The present invention provides an accessory for securing a cigarette lighter that prevents loss while serving to hold or mount the lighter so that it is conveniently accessible. The accessory forms a compact unit with a lighter, which is well-suited for being carried on or in the wearing apparel of both men and women, or, alternatively, on a substantially flat surface of a wall, panel, or other appropriate stationary or mobile support.

An important feature of the invention is that the unitary combination of lighter and accessory need not be mixed with other articles when not being used, especially in a pocket, purse, or drawer, but it may be carried or mounted externally on a user's apparel or other support, or may be carried internally in a fixed position in a pocket, and in either case, the lighter readily and quickly can be removed for use.

The cigarette lighter securing accessory of the invention includes a lighter holder adapted for receiving a cigarette lighter thereon, cord means adapted for interconnecting the holder and the lighter extensibly therebetween to enable use of the lighter at a location remote from the holder, and means for retracting the cord means from an extended position thereof, cooperatively with restoration of the lighter to the holder. The accessory preferably includes means on the holder for attaching it to a support.

A preferred additional element, which is employed advantageously with a replaceable and/or disposable lighter, is a receptacle, which is removably connected to the lighter. The cord means then is connected to the receptacle, to effect the interconnection of the holder and the lighter.

BRIEF DESCRIPTION OF THE DRAWINGS

The drawings illustrate preferred embodiments of the invention, without limitation thereto. In the drawings, like parts are identified by like reference symbols in each of the views, and.

DESCRIPTION OF THE PREFERRED EMBODIMENTS

Figure 1:
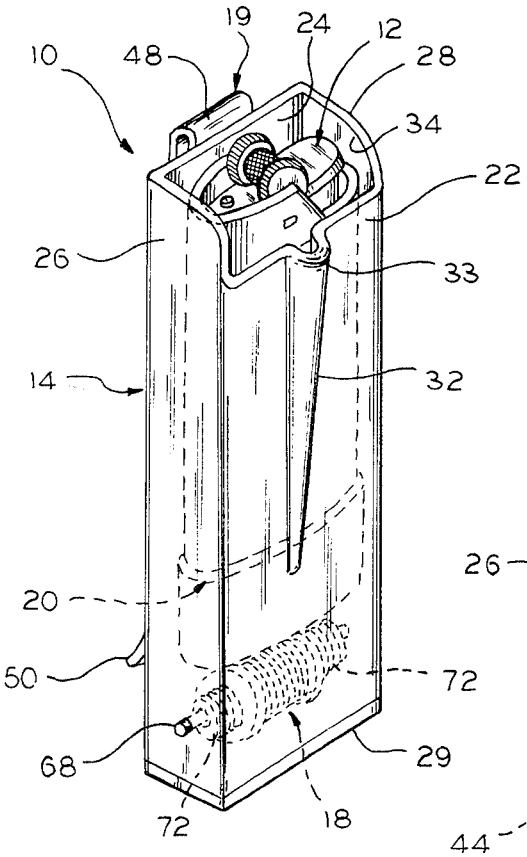
FIG. 1 is a perspective view of one embodiment of the accessory of the invention, having a cigarette lighter received within a holder thereof.
Figure 2:
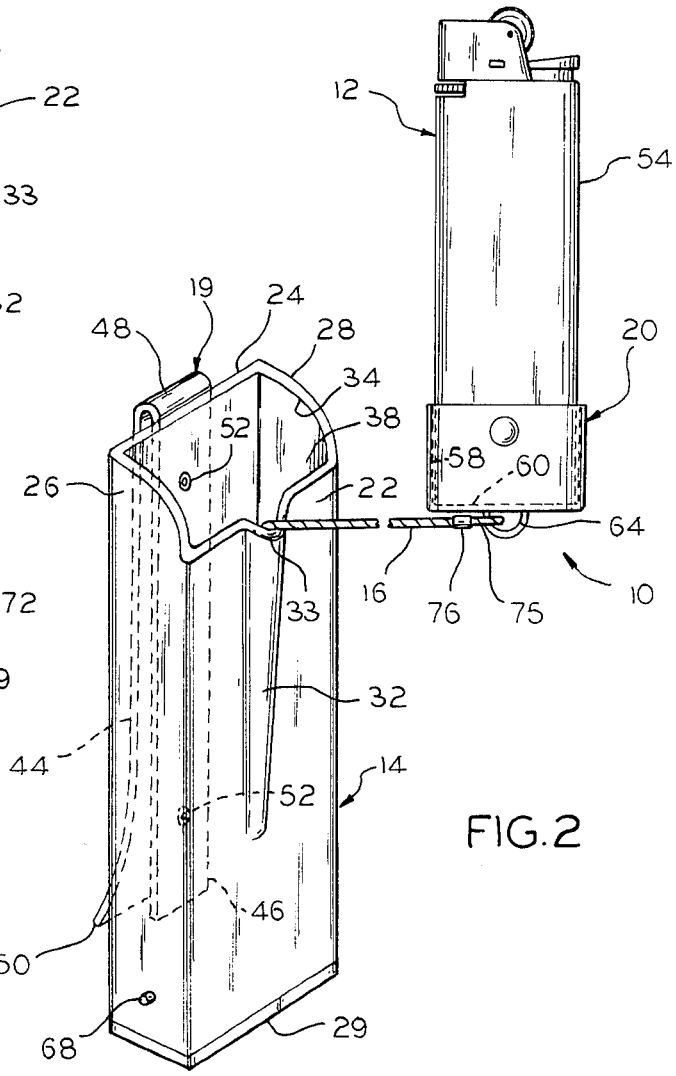
FIG. 2 is a perspective view of the embodiment of FIG. 1, illustrating the lighter removed from the holder.
Figure 3:
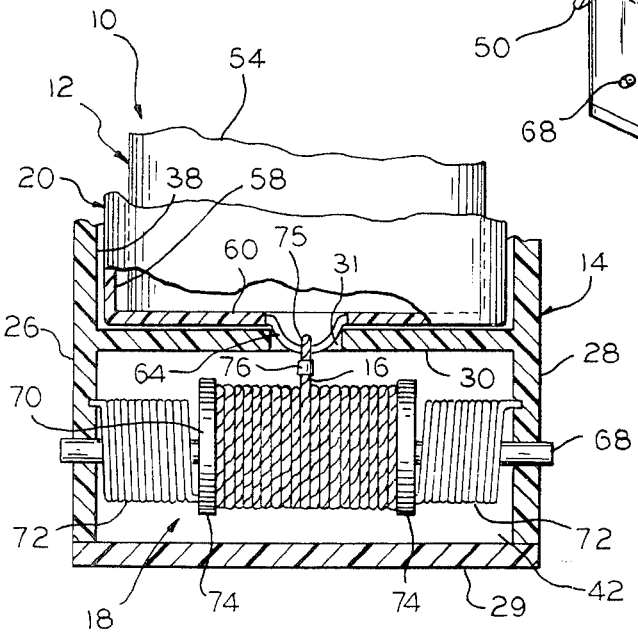
FIG. 3 is an enlarged fragmentary longitudinal or vertical sectional view of the embodiment of FIGS. 1 and 2, illustrating a cord means and a cord retracting means thereof.

Referring to FIGS. 1–3 of the drawings, a preferred embodiment of a securing accessory or securing means 10 for a generally conventional pocket-size hand-held cigarette lighter 12 includes a lighter holder 14, a cord 16 interconnecting the holder and the lighter extensibly therebetween, and a retractor 18 for retracting the cord from an extended position thereof. The accessory 10 further includes an attachment member 19 on the holder 14, and a cup-like receptacle 20 connected to the cord 16 and to the lighter 12 therebetween.

In the illustrative embodiment, the lighter 12 is a disposable unit, having lighter fluid more or less permanently sealed therein. Other lighters, whether or not disposable, may be employed replacably in combination with the accessory 10.

The holder 14 in the embodiment of FIGS. 1–3 more specifically constitutes a holster for the lighter 12. The holder 14 is a generally rectangularly-shaped case bounded by spaced, substantially parallel, upstanding front and back walls 22 and 24, respectively, and spaced, substantially parallel, upstanding side walls 26 and 28 respectively. The holder 14 is completed by a bottom wall 29 and, spaced thereabove, a partition or false bottom 30 having a central opening 31 extending therethrough.

The back wall 24 of the holder is rectangular. The side walls 26 and 28 are generally rectangular, except that their upper edges are convexly downwardly curved adjacent to the front wall 22. The front wall 22 is generally rectangular in shape and shorter than the remaining walls, so that its upper edge is recessed from or spaced below the upper edge of the back wall 24 and the rear horizontal portions of the upper edges of the side walls 26 and 28. The front wall 22 includes an integrally formed, outwardly projecting or convex guide channel or trough 32 that terminates at the top of the wall in a convexly curved lip 33. The front wall 22, the back wall 24, the side walls 26 and 28, and the partition 30 define a rectangularly-shaped lighter compartment 38 above the partition 30. The front, back, and side walls, the partition, and the bottom wall 29 define a rectangularly-shaped retractor compartment 42 beneath the partition.

In the illustrative embodiment, the front wall 22, the back wall 24, the side walls 26 and 28, and the partition 30 are integrally joined together, and the bottom wall 29 is secured to the bottom edges of such walls by suitable fastening means. Preferably, the holder 14 is formed of light-weight attractive and economical thermoplastic material, in any suitable manner, such as by molding. The bottom wall 29 is secured to the remaining walls after the retractor 18 is mounted in its compartment 42, in any suitable manner, such as by heat or solvent welding, or by an adhesive. Alternatively, the holder 14 may be formed of metal or other suitable material.

The attachment member 19 is constructed in the form of a bent flat spring clip. The attachment member 19 includes outer and inner arms 44 and 46, respectively, joined together at their upper ends by a reverse bend 48. The lower ends of the arms are free, and the outer arm 44 is arcuately bent, to diverge from the inner arm 46 at the lower ends of the arms, and thereby provide a relatively wide entry 50 thereat. The attachment member 19 is secured to the back wall 24 of the holder by any suitable means. In the illustrative embodiment, the inner arm is secured to the back wall 24 by rivets 52 extending through the two members.

The attachment member 19 may be formed of spring metal or of resilient plastic, as desired. When both the holder 14 and the attachment member 19 are made of plastic, they may be secured together by suitable methods of joining plastic parts, such as described above for securing the bottom wall 29, depending upon the respective materials of construction. In another alternative, the attachment member 19 may be formed integrally with the holder 14 of the same thermoplastic material, for example, a polyolefin, such as polypropylene.

Referring particularly to FIGS. 2, 3, 6, and 7, the lighter 12 has a generally conventional oval-shaped tubular side wall 54, modified from the conventional construction to provide a pair of generally hemispherical bosses or nibs 56 on opposite sides of the wall, adjacent to and spaced from the bottom end of the wall. The bosses are disposed generally in a transverse or horizontal plane through the wall 54, in opposed relation on a minor axis of the oval perimeter of the wall in such plane.

The receptacle 20 has an oval-shaped tubular side wall 58 and an integral bottom wall 60. The inner surface of the side wall 58 is provided with indentations 62, which are complementary to the lighter bosses 56 and are disposed on opposite sides of the wall in opposed relation, in a transverse or horizontal plane through the wall and on a minor axis of the oval perimeter of the wall in such plane. The receptacle includes an arcuate connecting member 64, which projects downwardly or outwardly from the bottom wall 60. The connecting member 64 may be formed integrally with the bottom wall 60, as illustrated in FIG. 3, or may constitute a separate part fixed thereto.

The side wall 58 of the receptacle 20 is similar to the side wall 54 of the lighter 12, the former wall receiving the latter wall telescopically therein. The receptacle wall 58 normally lies closely adjacent to the lighter wall 54 on their flatter sides, while the walls are spaced apart on their sides of greater curvature, as represented by the spaces 66 between the walls where they are intersected by the major axes of their perimeters. The bosses 56 are received in the indentations 62, to interconnect the lighter and the receptacle.

Figure 7:
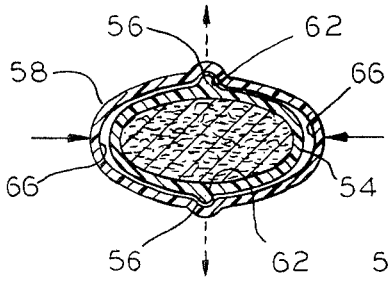
FIG. 7 is a cross-sectional view of the lighter and receptacle, taken substantially on line 7—7 of FIG. 6.

The receptacle side wall 58 is sufficiently flexible that it may be distorted by pressure applied to the opposite sides of greater curvature, along the line of the major axis, as illustrated by the full-line arrows in FIG. 7. Such pressure, exerted by a thumb and a finger of the hand, causes the remaining, flatter sides to bow outwardly, in the directions illustrated by the broken-line arrows in FIG. 7. Thereupon, the indentations 62 move away from the bosses 56, permitting the receptacle 20 to be withdrawn from the bottom of the lighter 12. When a lighter is inserted into the receptacle, the bosses 56 cam the receptacle side wall 58 outwardly, until the bosses are received in the indentations 62, for interconnecting the lighter and the receptacle.

The lighter side wall 54 and the receptacle side wall 58 may be made of similar or dissimilar materials; for example, either or both may be made of plastic or metal. In the illustrative embodiment, the lighter wall 54 is made of plastic, as employed in disposable lighters, and the receptacle 20 is made of plastic. It may be advantageous to make the receptacle 20 of metal rather than plastic, for greater durability and maintenance of a tight connection over an extended period of use, with numerous lighter insertions and removals.

The lighter 12 and the receptacle 20 thereon are inserted through the access opening 34 in the holder 14, and received in the lighter compartment 38 in a normally upright position, with the receptacle 20 seated on the partition 30. The connecting member 64 of the receptacle 20 is received in the opening 31 in the partition. The lighter compartment 38 is dimensioned so that the top of the lighter 12 is readily accessible through the access opening 34 at the top of the holder 14, while the lighter is being carried in the holder. If desired, the compartment 38 may be dimensioned so that the top of the lighter 12 projects above the top of the holder.

The retractor 18, of conventional construction, is mounted in the retractor compartment 42. The retractor 18 includes a shaft 68 having its opposite ends fixedly mounted in the holder side walls 26 and 28, a reel or drum 70 rotatably mounted on the shaft, and coil springs 72 mounted around the shaft at opposite ends of the reel. The reel 70 has a pair of raised rims 74 at opposite ends thereof. Opposite ends of the coil springs 72 are connected to or embedded, respectively, in a side wall 26 or 28, and an adjacent rim 74. In this manner, the reel 70 is spring-biased into an initial rotational position.

The cord 16 is connected at one end to the reel 70, in any suitable manner, and wound thereon. The opposite end of the cord is connected to the connecting member 64 of the receptacle 20. A loop 75 is formed on the cord end, to provide a link engaging the connecting member, and the loop is secured by a fastener 76 around the loop ends. As thus connected, the cord 16 is unwound from the reel 70 and passes through the partition opening 31 as the lighter 12 is pulled out of the lighter compartment 38, against the bias of the retractor springs 72.

The accessory 10 is especially adapted for removably attaching the holder 14 to an article of wearing apparel, in particular, a belt or the pocket of a garment. Thus, the attachment member 19 receives the edge of a belt or a free edge of a pocket in the entry 50, and the attachment member is pushed onto the belt or the corresponding side of the pocket, to clamp the same securely between the arms 44 and 46 of the member. In this manner, the accessory 10 may be suppoted on a belt around trousers, a coat, or a jacket, or on the inside or outside of an external or internal pocket of a garment, as most convenient and desirable for the user. When the user wishes to use the lighter, it is pulled out and extended to the article being lighted, whether for himself or another person. The cord 16 tends to follow the path provided by the guide channel 32 when pulled away from the body, and the rounded lip 33 assists in preventing wear of the cord.

Following use, the lighter is restored to the holder, while the retractor 18 retracts the cord 16 and winds it on the reel 70, under the tension of the springs 72, cooperatively with the restoration of the lighter. The lighter will not be left behind or carried away by another, and it will not fall out of the holder while being carried on the person. It may be separated completely from other articles being carried by the user, or it may be placed in a pocket containing other articles, where, however, it is separated by the holder 14.

Figure 4:
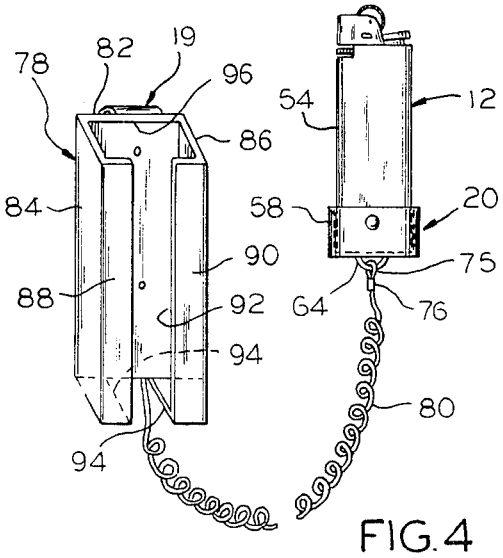
FIG. 4 is a perspective view of a second embodiment of the accessory, illustrating a lighter removed from a holder thereof.

FIG. 4 illustrates another type of holder 78, which is employed with a helically-wound coil spring cord 80. The holder 78 is of generally rectangular configuration, formed of upstanding walls, including a back wall 82, spaced parallel side walls 84 and 86, and a front wall composed of two panels 88 and 90 in spaced parallel relation to the back wall 82. The walls are integral with adjacent walls along their vertical edges, and the front wall panels 88 and 90 have inner vertical edges which are spaced apart, to define a slot 92 between them, from top to bottom. The holder 78 is completed by a bottom wall composed of two panels 94 and extending from the bottom edges of the front wall panels 88 and 90 to the bottom edge of the back wall 82. The back wall 82, the side walls 84 and 86, and the front wall panels 88 and 90 define an access opening 96 at their upper ends.

The holder 78 may be formed of plastic, metal, or other suitable material, as desired. An attachment member 19 is secured to the back wall 82, in a manner such as described for securing the attachment member to the holder 14 in the preceding embodiment.

The coil spring cord 80 is connected at one end to the bottom of the holder 78 in any suitable manner, and at the opposite end to the connecting member 64 of a receptacle 20, by means of a loop 75 and a fastener 76, as described for the preceding embodiment. The coil spring cord 80 functions both to interconnect the holder 78 and a lighter 12, via the receptacle 20, and to provide means for retracting the cord from an extended position thereof. The coil spring cord 80 may be constructed of spring metal, resilient plastic, or other suitable material or combination of materials.

The assembled lighter 12 and receptacle 20 are inserted into the holder 78 through the access opening 96 at its upper end, and seated on the bottom wall panels 94. The coil spring cord 80 is accommodated by the slot 92, as the lighter is being inserted. In this embodiment of the accessory, the cord, rather than being wound up when retracted, is allowed to hang freely from the holder 78.

The embodiment of FIG. 4 may be carried on the person in the same ways as described for the preceding embodiment, and used in the same manner, with substantially the same advantages. With this embodiment, the connecting spring cord 80 may serve as an article of ornamentation, providing lan ornamental loop while the lighter is in the holder, yet having its coils sufficiently flexible and extensible to enable use of the lighter at a location remote from the holder, and having sufficient spring tension to retract the cord, whereby a relatively short and compact connection is provided.

Figure 5:
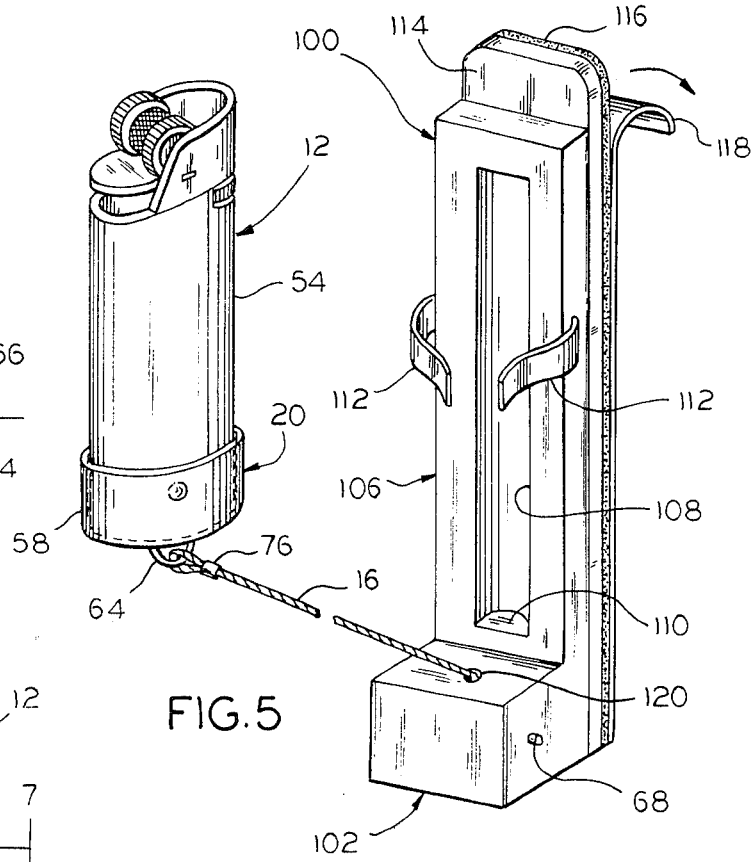
FIG. 5 is a perspective view of a third embodiment of the accessory, illustrating a lighter removed from a holder thereof.
Figure 6:
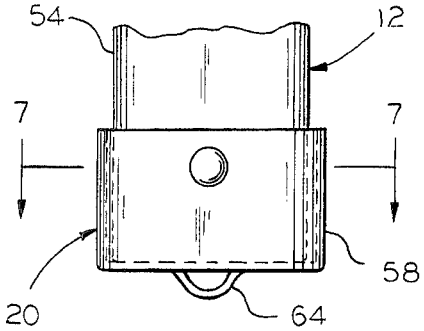
FIG. 6 is an enlarged fragmentary view of the bottom end of the lighter and a receptacle connected thereto, as shown in the preceding views.

While the accessories of the embodiments of FIGS. 1–4 have been described with particular reference to their being carried on the person, it will be apparent that they may be supported on inanimate bodies or objects, for example, such as have a rim which may be received in the entry 50 of the attachment 19, to support the accessory thereon. The embodiment of FIG. 5 is more specifically intended for being mounted on inanimate bodies, and, in particular, is adapted for attaching a holder 100 thereof to a generally flat surface of a wall, panel, post, or the like. The holder 100 includes a generally rectangular hollow base 102, and an upright support 106 integrally mounted on the base along its rear edge. The support is provided with a vertically elongated rounded lighter-mounting recess 108, the bottom end of which is defined by a corresponding surface 110 on the support. A pair of bent flat spring clamps 112 is mounted on the support, with one clamp being secured to each of opposite vertical sides of the support and extending in front of the recess 108, in spaced apart opposing relation, intermediate the upper and lower ends of the support.

The holder further includes a back panel 114, which extends for the height of the base 102 and the support 106, and above the support. A layer of pressure-sensitive adhesive 116 is adhered to the back of the back panel 114, and covered by a peelable release liner or strip 118, according to coventional practice in the use of pressure sensitive adhesives.

The base 102 and the support 106 are conveniently molded in one piece of thermoplastic material, and the back panel 114 may be formed of the same or dissimilar material. The clamps 112 may be formed of spring metal or resilient plastic.

A retractor 18 having a cord 16 wound thereon, as in FIG. 3, is mounted within the base 102, with the ends of the retractor shaft 68 supported in opposite side walls of the base. The cord 16 extends through an opening 120 in the top of the base 102, and its outer end is connected to the connecting member 64 of a receptacle 20, receiving a lighter 12 therein, as described above with reference to FIGS. 1–3. A narrow side of the assembled lighter 12 and receptacle 20 is received in the mounting recess 108, with a portion of the receptacle seated on the surface 110 at the bottom of the recess. The lighter 12 is inserted between the ends of the clamps 112, and the clamps hold the lighter securely on the holder 100.

The accessory of FIG. 5 may be mounted on any suitable substantially flat surface. Mounting is accomplished simply by removing the release liner 118 from the adhesive layer 116, and after placing the adhesive layer against the surface, pressing the holder 100 firmly towards the surface, to cause the adhesive layer to adhere thereto. The accessory may be mounted in this manner, with the back of its holder 100 lying flat against the flat surface of a household wall or panel, an automobile panel, a post, or other appropriate structure. The lighter is continuously available for use, and not subject to being lost, misplaced, or accidentally taken away. It is removed for use and replaced generally in the same ways as described for the embodiment of FIGS. 1–3, with the lighter being removed from between the clamps 112 and replaced therebetween, and the cord 16 being pulled out of the base 102 against the bias of the coil springs 72 (FIG. 3) and retracted into the base, cooperatively with return of the lighter to the holder, in the same manner as described above.

Alternatively, the receptacle 20 having the lighter 12 received therein may be connected to the base or bottom of a holder similar to the holder 100 in FIG. 5, by the coil spring cord 80, in the manner illustrated in FIG. 4. The cord 80 then functions in the same manner as described above for the cord in FIG. 4, and, likewise, it hangs freely from the holder, in contracted form, when the lighter and receptacle are supported by the holder.

Figure 8:
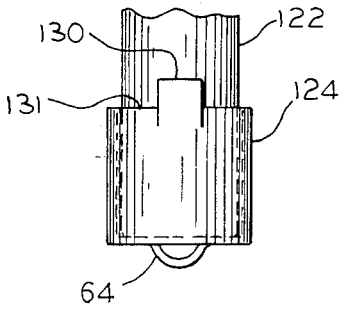
FIGS. 8 and 9 are fragmentary elevational views of another combination of a lighter and a receptacle connected to the bottom end thereof, having modified interconnecting means, with the view of FIG. 9 being taken at a right angle to the view of FIG. 8 and also having parts broken away and shown partly in section.
Figure 9:
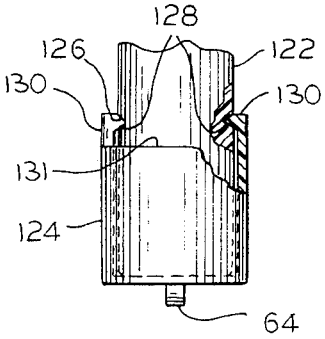

FIGS. 8 and 9 illustrate a lighter wall 122 and a receptacle 124 which have been provided with modified interconnecting means. Thus, the cylindrically-shaped lighter wall 122 is provided with a pair of diametrically-opposed notches or grooves 126 which receive prongs 128 or the like projecting inwardly at the outer ends of fingers 130, which project upwardly from the rim 131 of the receptacle 124. The fingers 130 are spread outwardly by cam action when the lighter wall 122 is inserted into or withdrawn from the receptacle 124. Alternatively, the receptacle 124 may be rotated relative to the lighter wall 122, to remove the prongs 128 from the notches 126, whereupon the lighter and the receptacle may be separated. The illustrative receptacle 124 is constructed of resilient, flexible plastic, but may, alternatively, be constructed of metal or other suitable material. The lighter wall 122 also may be constructed of plastic, metal, or other material.

Figure 10:
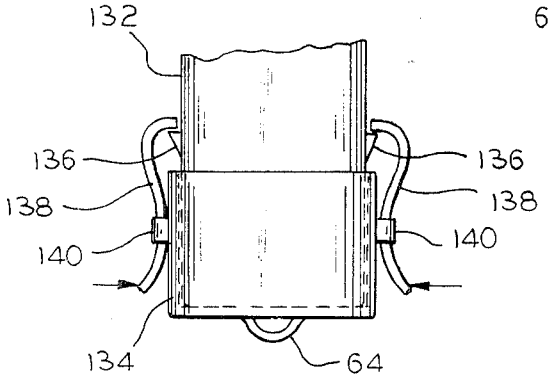
FIG. 10 is a fragmentary elevational view of an additional combination of a lighter and a receptacle, having modified interconnecting means.

FIG. 10 illustrates further modifications in means interconnecting a lighter wall 132 and a receptacle 134. The oval lighter wall is provided with a pair of catches 136 on opposite sides thereof, in opposed relation. The oval receptacle 134 is provided on opposite sides thereof with a pair of latch members 138 connected to the receptacle by resilient hinge mountings 140. The latch members 138 engage the catches 126 for removably connecting the receptacle 134 to the lighter wall 132.

In the illustrative embodiment, the catches 136 are integral with the lighter wall 132, being unitarily molded from plastic. The receptacle 134, the latch members 138, and the hinge mountings 140 are integrally molded from plastic, in accordance with known procedures, whereby when the latch members 138 are disposed in their illustrative positions, the hinge mountings 140 are under stress, serving to bias the upper ends of the latch members 138 into engagement over the catches 136. For this purpose, the receptacle and attachments may be molded of a polyolefin for example, polypropylene. Pressure is exerted against the lower ends of the latch members 138, as indicated by the arrows, when it is desired to disengage the latch members from the catches 136. When pressure is released, the latch members 138 return to their illustrative positions.

The accessories of the foregoing views embody preferred mechanical means for removably connecting a receptacle to a lighter, and other such means may be employed alternatively. In a further alternative, requiring no modification of the lighter wall, the receptacle side wall may receive the lighter side wall telescopically therein with a friction fit sufficient to removably connect the receptacle to the lighter.

The above embodiments of the accessory are preferred for use with the well-known disposable lighters or the like, which are discarded when their fuel is exhausted. A connection to such a lighter advantageously is made on or utilizing its side wall, and a receptacle well serves to make such a connection. Nevertheless, a cord means may be connected directly to a suitably-constructed lighter. This type of connection is especially desirable and adaptable to lighters which are expected to have a relatively long life, in particular, refillable lighters.

Figure 11:
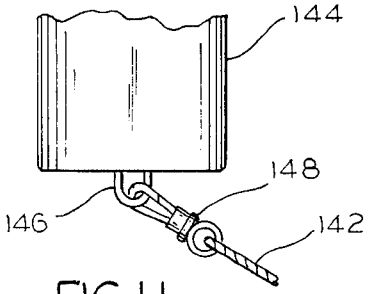
FIG. 11 is a fragmentary elevational view of the modified bottom end of a further lighter, illustrated with a portion of a cord means connected thereto.

FIG. 11 illustrates the direct connection of a cord 142 to a lighter 144. In this case, a staple-like connecting member 146 is attached to the bottom of the lighter 144. The end of the cord 142 is attached to a conventional snap hook 148, which in turn is connected to the connecting member 146. Alternatively, a link may be substituted for the hook 148, to provide additional security. The remainder of the accessory may be the same as described in connection with any of the embodiments of FIGS. 1–5.

While preferred embodiments of the accessory are illustrated in the drawings, it will be apparent that the accessories are useful even without their means for attachment to a support. Thus, for example, the holder 14 illustrated in FIGS. 1–3 may be employed without the attachment member 19, by wedging it into a carrying loop or loops, or the like, on an article of wearing apparel, or other support, to provide a restraint for the accessory. However, it is preferred that means be included for positively securing the accessory to a support.

While certain preferred embodiments of the invention and modifications thereof have been illustrated and described, it will be apparent to those skilled in the art that various other changes and modifications may be made therein, within the spirit and scope of the invention. It is intended that all such changes and modifications be included within the scope of the appended claims.

I claim:

1. Cigarette lighter securing accessory comprising, in combination:

a lighter holder adapted for receiving a cigarette lighter thereon, a lighter receptacle, said receptacle receiving said lighter therein, means for removably connecting said receptacle to said lighter, cord means interconnecting said holder and said receptacle extensibly therebetween to enable use of said lighter at a location remote from said holder, and means for retracting said cord means from an extended position thereof, cooperatively with restoration of said lighter to said holder.

2. The accessory of claim 1 and including means on said holder for removably attaching the holder to an article of wearing apparel.

3. The accessory of claim 1 and including means on said holder for attaching the holder to a substantially flat surface.

4. The accessory of claim 1 wherein said receptacle is adapted to receive the bottom of said lighter therein.

5. Cigarette lighter securing accessory comprising, in combination:

a lighter holder adapted for receiving a cigarette lighter thereon, means on said holder for attaching it to a support, a lighter receptacle said receptacle receiving said lighter therein, means for removably connecting said receptacle to said lighter, cord means interconnecting said holder and said receptacle extensibly therebetween to enable use of said lighter at a location remote from said holder, and means for retracting said cord means from an extended position thereof, cooperatively with restoration of said lighter to said holder.

6. The accessory of claim 5 wherein said retracting means comprises spring-actuated cord reel means.

7. The accessory of claim 5 wherein said cord means and said retracting means together comprise a helically-wound coil spring.

8. The accessory of claim 5 wherein said holder comprises a holster for receiving said lighter therein, and said attaching means is adapted for removably attaching the holder to an article of wearing apparel comprising a belt or a garment pocket.

9. The accessory of claim 8 wherein said receptacle is adapted to receive the bottom of said lighter therein.

10. In combination with a cigarette lighter, an accessory for securing the lighter comprising:

a lighter holder adapted for receiving said lighter thereon, a lighter receptacle, said receptacle receiving said lighter therein, means for removably connecting said receptacle to said lighter, cord means interconnecting said holder and said receptacle extensibly therebetween to enable use of said lighter at a location remote from said holder, and means for retracting said cord means from an extended position thereof, cooperatively with restoration of said lighter to said holder.

* * * * *